United States Patent [19]

Kasam

[11] Patent Number: 5,008,502

[45] Date of Patent: Apr. 16, 1991

[54] POWER SWITCHING CONTACTOR

[76] Inventor: Nawaz I. Kasam, 7586 Northway Dr., Hanover Park, Ill. 60103

[21] Appl. No.: 307,829

[22] Filed: Feb. 3, 1989

[51] Int. Cl.[5] ..... H01H 1/32; H01H 9/04

[52] U.S. Cl. ..... 200/248; 200/302.1

[58] Field of Search ..... 200/50 C, 248, 287, 200/244, 249, 250, 247, 282, 401, DIG. 6, 23, 24, 6 R, 273, 274, 23, 24, 570, 302.1; 335/8, 9, 10, 16, 166, 169; 384/432, 433, 434, 627

[56] References Cited

U.S. PATENT DOCUMENTS

| | | | |
|---|---|---|---|
| 1,863,142 | 6/1932 | Sisson | 384/434 |
| 3,038,054 | 6/1962 | Naimer | 200/302.1 |
| 3,263,042 | 7/1966 | Dyer et al. | 335/8 |
| 3,271,533 | 6/1966 | Butler | 200/570 X |
| 3,908,104 | 9/1975 | Mitchetti | 200/50 C |

*Primary Examiner*—J. R. Scott

*Attorney, Agent, or Firm*—Rockey and Rifkin

[57] ABSTRACT

A power switching contactor for electrical loads having an improved contactor shaft which provides a bearing system for non-binding, efficient operation and easy replacement and also provides a self-alignment feature of the contactor arms with the stationary contact pads.

3 Claims, 3 Drawing Sheets

POWER SWITCHING CONTACTOR

BACKGROUND AND SUMMARY OF THE INVENTION

The present invention relates to improved power switching contactors for electrical loads and more particularly to improved quick change contactor shafts which are easily replaceable, provide non-binding bearing mounts and also provide for selfaligning contact pillows for the contact arms.

Known power switching contactors for electrical loads, many of which are remote control, become difficult and expensive to maintain when the contactor shaft, contactor arm or contactor parts become worn due to stress, erosion and repeated use from electrical loads. In known devices, the contactor shaft is difficult to remove and replace because of the bearing arrangements and the manner in which the contactor shaft and bearings are integrated and aligned with the remainder of the power switching components and housing. Also because of the known bearing arrangements, many known devices are subject to binding. Additionally, with the known devices, alignment of the contact arms with the stationary contacts shifts with wear. This misalignment causes electrical inefficiency and increased wear on the contact arms and contact pads.

BRIEF SUMMARY OF THE INVENTION

Therefore, an object of the present invention is to provide an improved power switching contactor for electrical loads that can be manually or electrically/electronically controlled.

Another object of the present invention is to provide an improved apparatus that has a non-binding contactor shaft that is easily replaceable.

A further object of the present invention is to provide an apparatus with a bearing that is easily installed and removed and that prevents jamming or binding regardless of installation.

An additional object of the present invention is to ensure an apparatus that has self-aligning contact arms to stationary contacts.

Still another object of the present invention is to provide an improved apparatus that is efficient in operation and economical to manufacture and use.

In accordance with the present invention, an improved power switching contactor for electrical loads and, in particular, an improved contactor shaft is provided having a means for mounting the contactor shaft which is non-binding and easily replaceable. A means for permitting self-alignment of a plurality of contact arms against a plurality of stationary contact pads is also provided either alone or in combination with the contactor shaft mounting means.

In a preferred embodiment of the present invention, a power switching contactor is provided having a housing which stores the electrical and mechanical components of the switching contactor. A moveable contactor shaft is also provided that is mounted along the width of the housing having a plurality of contact arms, the shaft enabling selective engagement of the contact arms with a plurality of stationary contact pads. In this manner, the contactor shaft may be rotated to selectively open and close the circuit of the power switching contactor.

The contactor shaft is moveable from an open or closed position by the use of a bearing at both ends of the contactor shaft which permits non-binding operation and easy installation. In another preferred embodiment of the present invention, a filler block is provided. The filler block is integral with the housing that engages the bearings and further enables efficient installation and replacement of the bearings and the shaft.

Another preferred embodiment of the present invention, either alone or in combination with the shaft mounting system, is a self-alignment feature of the contact arms. This feature is accomplished by providing a plurality of alignment pillows which are located on the contactor shaft at the cradle points where the contact arms are secured to the housing. The pillows permit side-to-side rocking action of the contact arms which, when in closed position, come in contact with the stationary contact pads, thus, completing the electrical circuitry. In this manner, the contact arms are self-aligning against the stationary contact pads and further provide a self-cleaning feature of the contact arms.

BRIEF DESCRIPTION OF THE DRAWINGS

These and other features, objects and advantages of the present invention will become apparent from the following description and drawings wherein like reference numerals represent like elements in the several views, and in which.

DETAILED DESCRIPTION OF THE PREFERRED EMBODIMENTS

Figure 1:
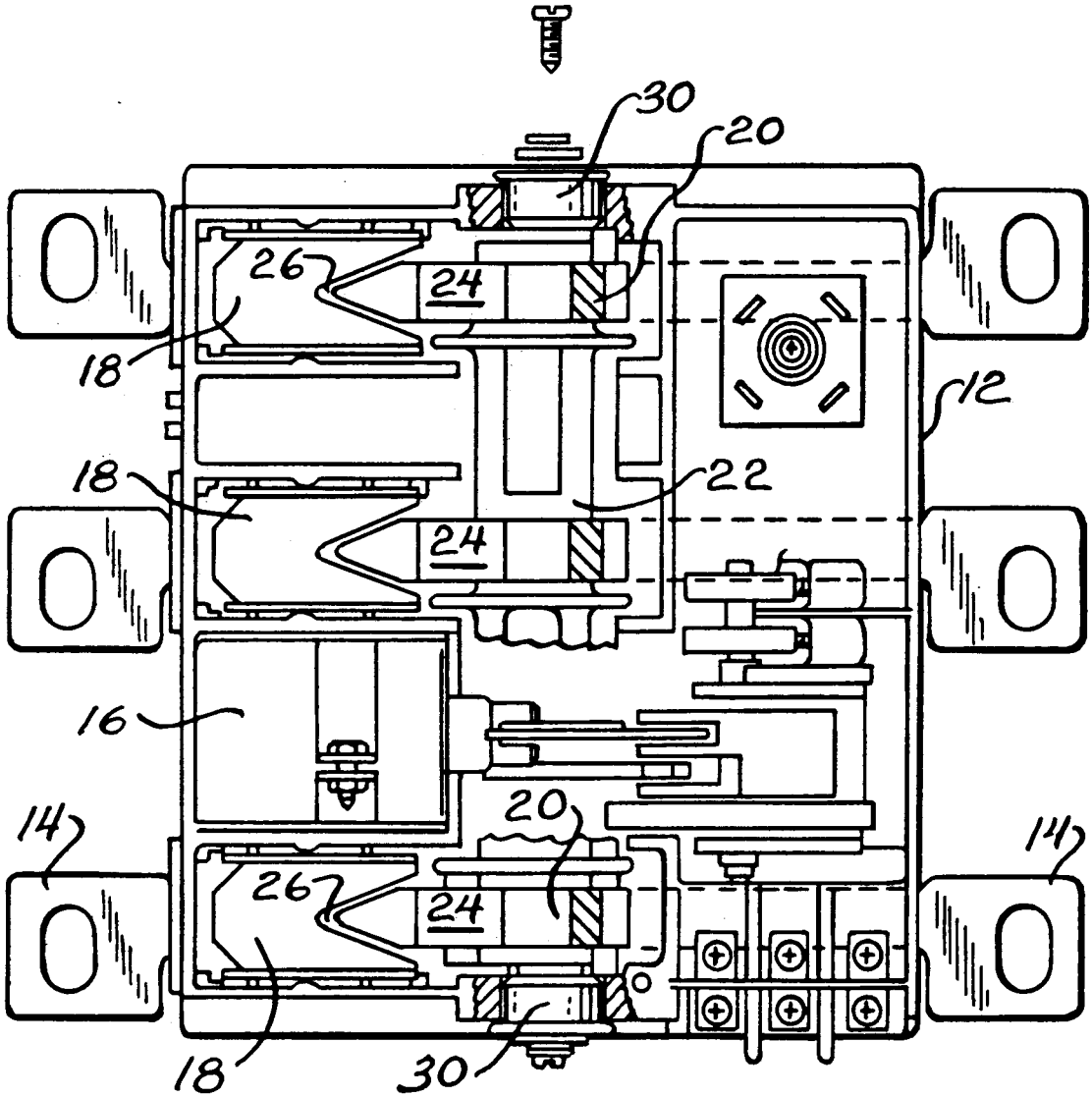
FIG. 1 is a top view of the present invention with the contactor shaft in a closed position and the contact arms in contact with stationary contact pads.

The power switching contactor of the present invention is shown generally as 10 in FIG. 1. Power switching contactor 10 has a housing 12 which includes a cover (not shown). A plurality of terminals 14 are provided which enable the switching contactor 10 to be part of an entire electrical system (not shown), typically in an industrial switching application. Other electrical and mechanical components present within housing 12 include a switching solenoid 16, arc splitting guides 18, flexible electrical connectors 20 and various other electrical and mechanical power switching contactor components well known to those of ordinary skill in the art.

Housing 12 also provides quick change support for a moveable contactor shaft 22. Contactor shaft 22 provides a means to mount a plurality of contact arms 24, such as the cradles 44 best shown in FIG. 2, and is supported at each end by a bearing means 30 at each of its two ends. The contactor shaft 22 is shown in a closed position in FIG. 1 with the contact arms 24 in contact with a matching plurality of stationary contact pads 26. When in the closed position, the circuit of power switching contactor 10 is complete. When it is desired to disconnect or open the circuit, contactor shaft 22 may be manually or automatically rotated to disengage contact arms 24 from stationary contact pads 26.

Figure 2:
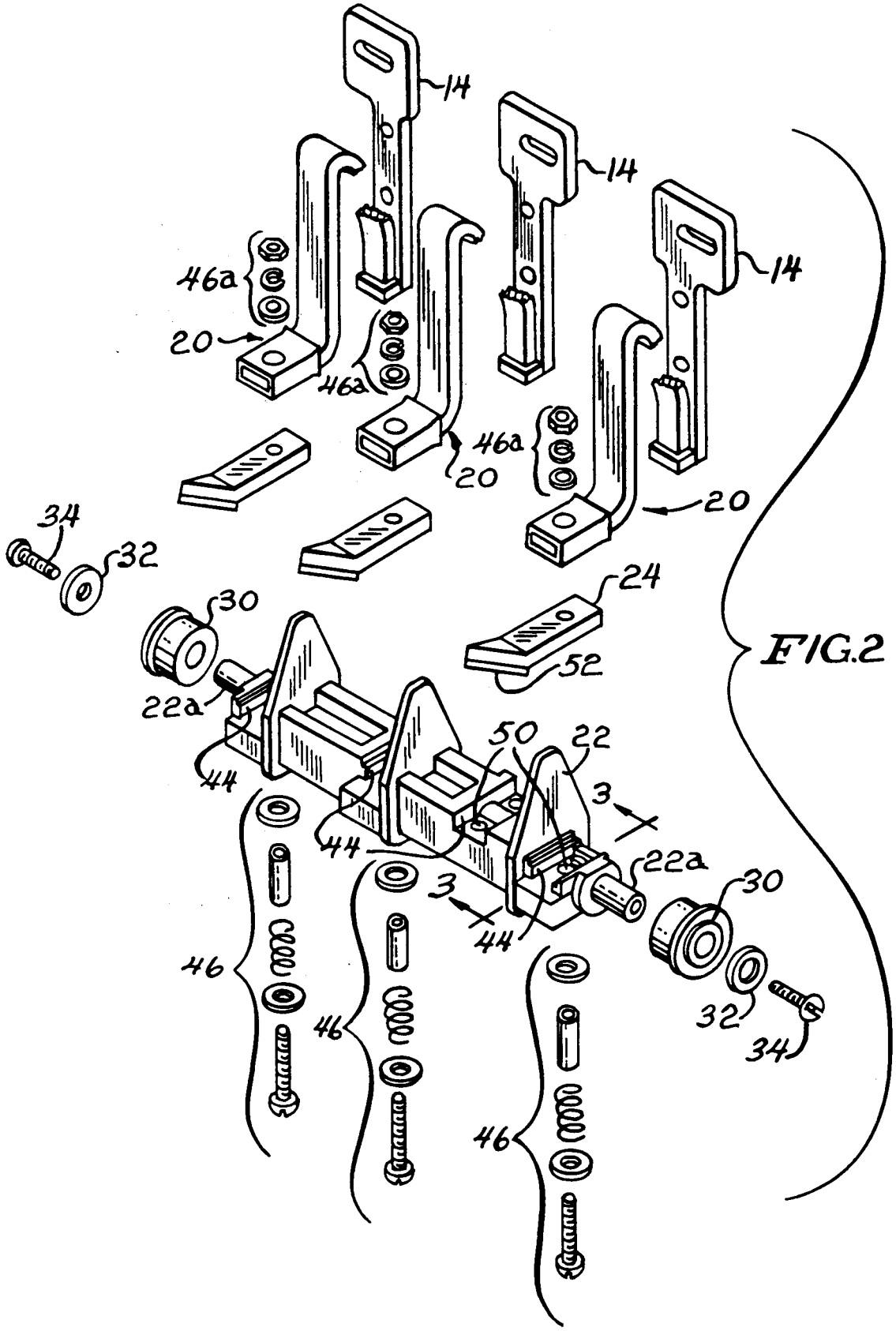
FIG. 2 is an exploded perspective view of the contactor shaft and components associated with the shaft.

The improved contactor arm 22 can best be seen by reference to FIG. 2. In a preferred embodiment, bearings 30 are secured over a portion 22*a* of each end of contactor shaft 22 by means of a stress reducing washer 32 and a self-tapping screw 34. Bearings 30, and hence contactor shaft 22 are made integral with housing 12 which provides a suitable hole and slot arrangement for placement of bearings 30 (hereinafter described). Bearings 30 are held snugly on housing 12 by a series of serrations (not shown). This engagement permits the non-binding operation and rotation of contactor shaft 22 within bearing 30.

Figure 2A:
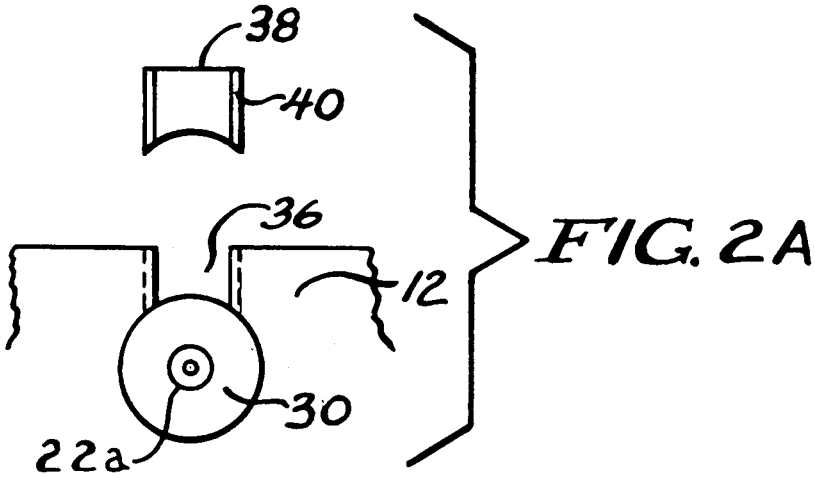
FIG. 2A is a side view of a portion of a housing showing the contactor shaft bearings, housing wall and filler block.

As can be better understood by reference to FIG. 2A, housing 12 provides an opening for bearing 30. The hole in housing 12 has a slot 36 which allows contactor shaft 22 to be inserted into the housing 12. To fill the space left by slot 36, a fillerblock 38 is provided that is grooved on its sides 40. Fillerblock 38 is then inserted into slot 36 and integral with housing 12 by its slots 40. Filler-block 38 completely fills the void of the slot 36. In this manner, contactor shaft 22 and/or bearings 30 may be easily installed and removed. This makes for easy installation, repair or replacement of contactor shaft or any other components, such as the contactor arms 24 that are associated with contactor shaft 22.

Contactor shaft 22 also provides for the placement of the contact arms 24 which will be referred to as cradles 44. Contact arms 24 are secured to contactor shaft 22 by screw assemblies 46 and corresponding nut assemblies 46*a* or other well known means at cradles 44.

Figure 3:
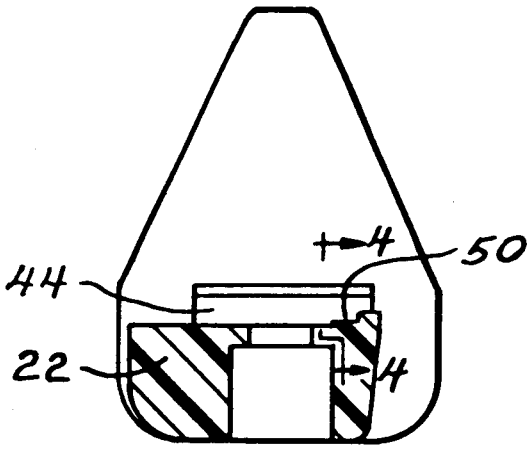
FIG. 3 is a cross-sectional view of the self-alignment pillows taken along line 3—3 of FIG. 2.
Figure 4:
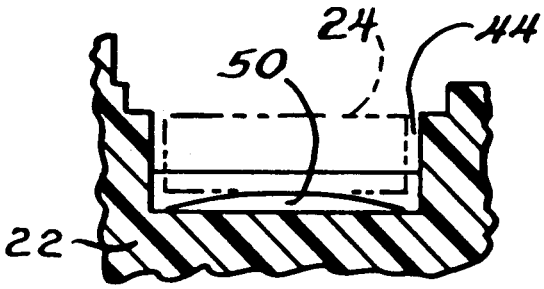
FIG. 4 is a cross-sectional view of the self-alignment pillow taken along line 4—4 of FIG. 3.

Pillows 50 provide for side-to-side rocking or tilting of contact arms 24 with stationary contact pads 26 which can best be seen by reference to FIGS. 3 and 4. Pillows 50 are raised members located near the rear of cradle 44 and contact the contact arms 24 near their rear. Pillows 50 are contoured along the length of contactor shaft 22 (see also FIG. 2). In this manner, contact arms 24 can rock when secured in cradle 44 and in contact or closed position with the stationary contact pads 26. This provides a flat contact of the contact arms 24 with stationary contact pads 26. This rocking or tilting action of contact arms 24, which is enabled by pillows 50, also provide a self-cleaning feature of the contact end 52 of contact arms 24.

While preferred embodiments of the present invention have been illustrated and described, it will be understood by those of ordinary skill in the art that changes and modifications can be made without departing from the invention in its broader aspects. Various features of the present invention are set forth in the following claims.

What is claimed is:

1. A power switching contactor for electrical loads comprising:

(a) a housing for switching contacts;

(b) a rotatable contactor shaft having a plurality of contact arms selectively engageable with a plurality of contact pads;

(c) a means for mounting said shaft for rotation in said housing including:

(i) a pair of bearings each receiving one end of said shaft, and a pair of slots formed in said housing and dimensioned to receive said pair of bearings, and (ii) a pair of removable filler blocks dimensioned to be received in said slots and being releasably engageable with said bearings for sealing said housing to prevent entry of foreign matter.

2. A power switching contactor for electrical loads comprising:

(a) a plurality of stationary contacts;

(b) a contactor shaft having a plurality of contact arms secured thereto to enable the selective engagement of electrical loads when engaging said stationary contacts;

(c) means for rotatably mounting said contactor shaft; and (d) a plurality of alignment pillows positioned on said shaft adjacent the location where the contact arms are secured to said shaft, said alignment pillows being contoured so as to act as a fulcrum, whereby each contact arm can rock side-to-side about a corresponding pillow when its distal end engages the corresponding contact pad thereby to ensure proper electrical contact for efficient flow of electric current.

3. A power switching contactor for electrical loads comprising:

(a) a housing for switching contacts;

(b) a rotatable contactor shaft having a plurality of contact arms selectively engageable with a plurality of contact pads;

(c) a means for mounting said shaft for rotation in said housing including:

(i) a pair of bearings each receiving one end of said shaft, and a pair of slots formed in said housing and dimensioned to receive said pair of bearings, and (ii) a pair of removable filler blocks dimensioned to be received in said slots and being releasably engageable with said bearings for sealing said housing to prevent entry of foreign matter, (d) a plurality of alignment pillows positioned on said shaft adjacent the location where the contact arms are secured to said shaft, said alignment pillows being contoured so as to act as a fulcrum, whereby each contact arm can rock side-to-side about a corresponding pillow when its distal end engages the corresponding contact pad thereby to ensure proper electrical contact for efficient flow of electric current.

* * * * *